US006345722B1

(12) United States Patent
Wingate

(10) Patent No.: US 6,345,722 B1
(45) Date of Patent: Feb. 12, 2002

(54) DISPLAY RACK FOR GOLF CLUBS

(75) Inventor: Mark L. Wingate, Huntley, IL (US)

(73) Assignee: Chicago Show, Northfield, IL (US)

( * ) Notice: Subject to any disclaimer, the term of this patent is extended or adjusted under 35 U.S.C. 154(b) by 0 days.

(21) Appl. No.: 09/616,460

(22) Filed: Jul. 14, 2000

(51) Int. Cl.[7] ..... A63B 57/00

(52) U.S. Cl. ..... 211/70.2; 211/60.1; 248/519; 473/282

(58) Field of Search ..... 211/70.2, 60.1, 211/69.5; 298/346.03, 519, 520, 512; 473/282, 287

(56) References Cited

U.S. PATENT DOCUMENTS 1,539,153 A * 5/1925 Bennett ..... 47/41.11
1,742,659 A * 1/1930 Lovell ..... 211/69.5
2,666,967 A * 1/1954 Poitras ..... 422/117
2,992,012 A * 7/1961 Herold ..... 280/47.19
3,176,662 A * 4/1965 Williams ..... 211/69.5
3,245,164 A * 4/1966 Arenson ..... 40/491
3,377,043 A * 4/1968 King ..... 248/346.03
3,463,323 A * 8/1969 Riepe ..... 211/69.5
4,778,141 A * 10/1988 Bogar ..... 248/538
4,932,537 A * 6/1990 Martinsen ..... 211/70.4
5,065,540 A * 11/1991 Potter ..... 43/21.2
5,447,243 A * 9/1995 Graber ..... 211/69.5
5,527,010 A * 6/1996 Kao ..... 248/519
5,564,665 A * 10/1996 Resnick ..... 248/519

* cited by examiner

*Primary Examiner*—Daniel P. Stodola
*Assistant Examiner*—Gregory J. Strimbu
(74) *Attorney, Agent, or Firm*—Robert E. Brown; Michael A. Carrillo

(57) ABSTRACT

A low-profile display rack for at least one golf club, where the golf club includes a shaft having a first end and a second end. The first end of the shaft is attached to a golf club head and the second end of the shaft merges with a grip portion for allowing a user to hold the golf club. The display rack is comprised of a display housing having a top wall with at least one opening and a support member mounted within the opening. The support member is comprised of a support cap with an aperture for receiving the second end of the golf club, a top end and a bottom end. The bottom end of the support member is further comprised of support side wall that includes an upper portion and a lower portion. The upper portion of the support side wall is connected to the top end of the support member and the lower portion of the support side wall merges with a bottom wall. The grip portion of the golf club is inserted into the aperture in the support cap and rests on the bottom wall of the support member. The support member may also be releasably attached to the display housing. The top wall of the display housing may further include a plurality of openings for receiving a plurality of support members.

10 Claims, 4 Drawing Sheets

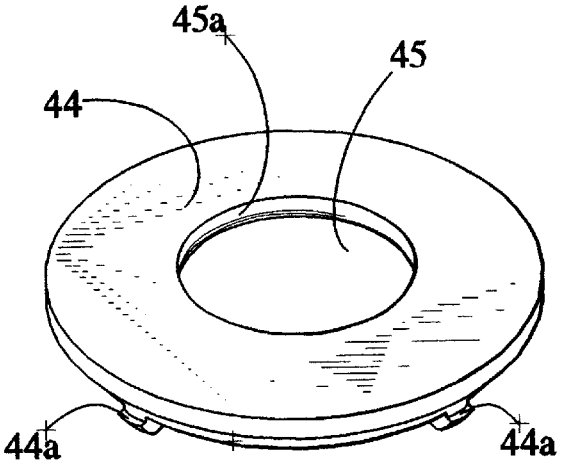
FIG. 6
FIG. 7
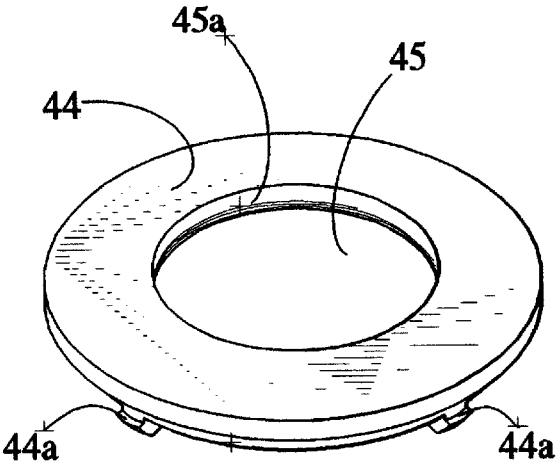
FIG. 9
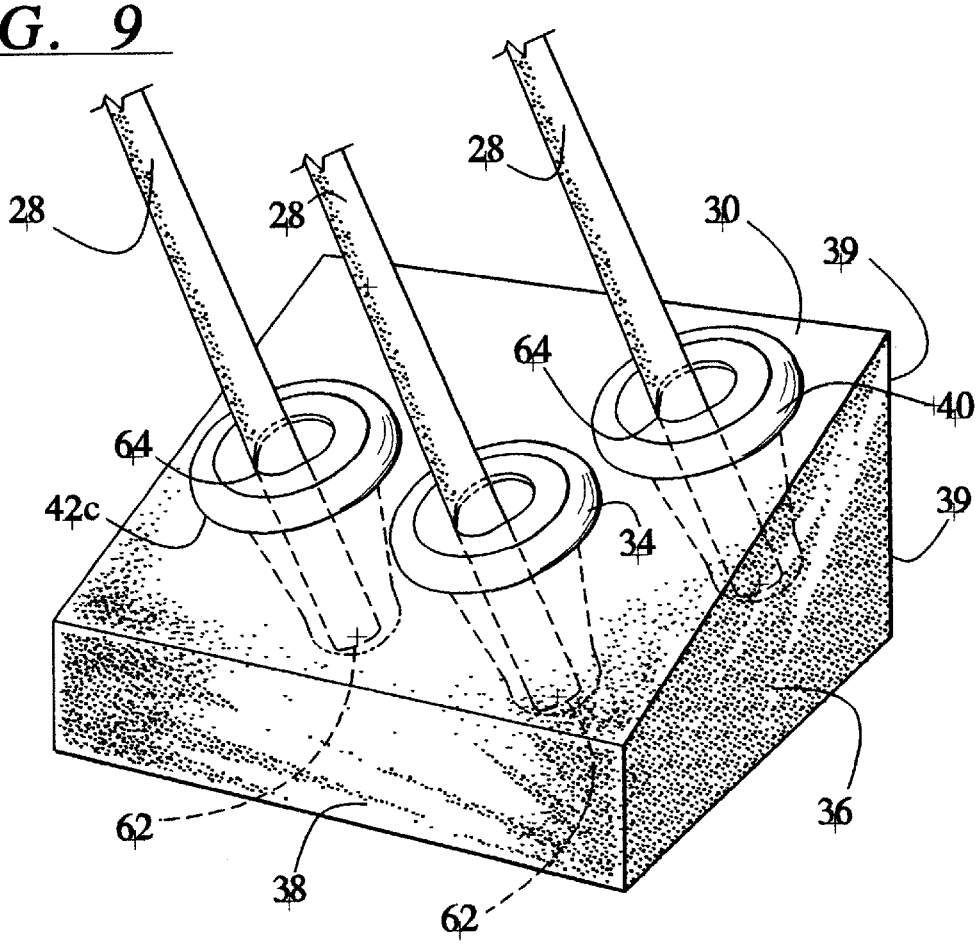

DISPLAY RACK FOR GOLF CLUBS

FIELD OF THE INVENTION

This invention relates generally to display racks for elongated articles such as golf clubs or the like. More particularly, the present invention relates to a low-profile display rack for supporting golf clubs.

BACKGROUND OF THE INVENTION

It is widely known in the art to provide display racks capable of supporting elongated articles such as golf clubs. Generally, these display racks include upper support sections and lower support sections which are separated by significant vertical distances such that the lower support section interacts with the golf club grip and the upper support section interacts with a portion of the golf club shaft nearer the golf club head. The problem with existing display racks is that they either require assembly or are difficult to move. An example of this type of display rack is shown in U.S. Pat. No. 3,786,915.

In addition, it is known in the art to provide golf club display racks with only one support member. Display racks which include only one support member generally provide a support member with a plurality of holes or recessed portions for receiving and supporting the golf club shaft near the golf club head, and these racks are generally mounted on walls or display housings. The problem with these display racks is that they are limited with regard to their location in a store, as they must be attached to walls or other supporting structures, and are difficult to move since these display racks would need to be unscrewed and reattached to other walls.

It is therefore an object of the present invention to provide a display rack for golf clubs which overcomes the problems associated with the prior art by providing a low profile display rack which does not require significant assembly or multiple supporting members and which may be readily displaced within a store and which is readily transportable.

SUMMARY OF THE INVENTION

The foregoing features and advantages of the present invention are achieved by providing a low-profile display rack for an elongated article such as a golf club and the like. An assembled golf club includes a shaft having a first end and a second end. The first end of the shaft is attached to a golf club head and the second end of the shaft includes a grip portion for allowing a user to hold the elongated article. The display rack of the present invention is comprised of a support member mounted on a display housing having a top wall with at least one opening and four side walls. The support member is mounted within the opening of the display housing and includes a support cap with an aperture for receiving the golf club. The support member also includes a support side wall which defines an inverted frustoconically shaped upper portion and a cylindrically shaped lower portion. The upper portion of the support side wall is connected to the support cap and the lower portion of the support side wall is attached to a bottom wall. The bottom wall may support the butt end of the grip portion of the shaft. The edge of the aperture in the support cap supports a second point on the grip portion of the golf shaft located between the butt end of the grip portion of the shaft and the golf club head. The lower portion of the support wall generally supports a point on the grip portion of the shaft located between the butt end and the aperture. The diameter of the lower portion of the support side wall is larger than the diameter of the grip portion of the shaft and the support member only interacts with the grip portion of the golf club. The present invention may also include means for attaching the support member to the display housing. The present invention may further include a plurality of openings on the top wall of the housing for receiving a plurality of support members. In addition, another embodiment of the present invention may include a display housing with a top wall and only two side walls or in the alternative, the display housing may include a top wall with four legs, i.e., one leg may be located at each of the corners of the top wall of the display housing. Further, an additional embodiment of the present invention may include a display housing which includes a top wall that is suspended from or attached to a supporting structure, but which does not include any sidewalls.

The foregoing and other features and advantages of the present invention which will be apparent from the following more detailed description of the invention.

BRIEF DESCRIPTION OF THE DRAWINGS

FIG. 6 is a top view of a support cap with a circular aperture;

FIG. 7 is a top view of a support cap with a oval aperture;

FIG. 9 is a perspective view of an alternative embodiment of the present invention.

DETAILED DESCRIPTION OF THE PREFERRED EMBODIMENT

Figures 1, 5:
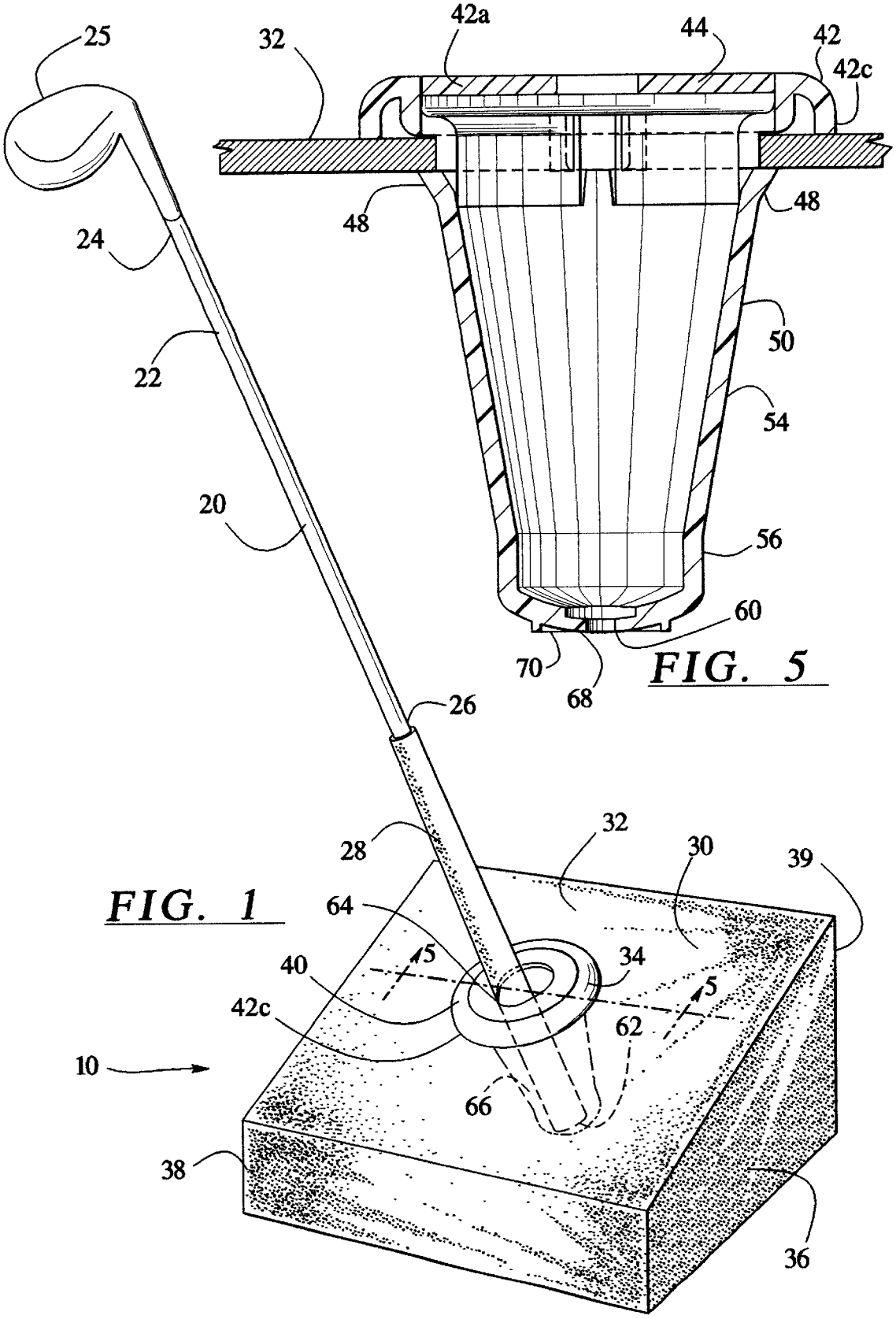
FIG. 1 is a perspective view of the present invention.
FIG. 5 is an enlarged sectional view of a mounted golf club support member shown in FIG. 1 along line 5—5.

While this invention is susceptible of embodiments in many different forms, there is herein described in detail, a preferred embodiment of the invention with the understanding that the present disclosure is to be considered as an exemplification of the principals of the invention and is not intended to limit the broad aspects of the invention to the embodiments illustrated herein.

In the preferred embodiment of the present invention, there is disclosed a display rack 10, capable of displaying and supporting an elongated article 20, such as a golf club or the like, where the golf club has a shaft 22 with a first end 24 and a second end 26. The first end 24 is attached to a golf club head 25 and the second end 26 includes a grip portion 28 for allowing a user to hold the golf club 20. The grip terminates in a butt end 62. As exemplified in FIG. 1, the display rack 10 includes a housing 30 having a top wall 32 which includes at least one opening 34, but which may also include a plurality of openings 34, and four side walls 36. In addition, alternative embodiments of the display rack 10 may include a housing 30 which has a top wall 32 attached to one of the following variations: (i) two side walls 36; (ii) a front side wall 36 and rear side wall 36; (iii) one side wall 36 attached to a supporting structure; or (iv) no side walls, but where the top wall is suspended from a supporting structure. The display housing 30 is preferably molded out of a polymeric material. The preferred embodiment of the display housing 30 is designed to be free standing and to be placed directly on a floor or other flat surface as a base for the display, however, the display housing 30 may also be attached to a supporting structure, such as, a wall or floor. The housing 30 includes a front wall 38 and a rear wall 39 where the rear wall 39 is slightly higher than the front wall 38 so that the top wall 32 of the housing 30 is higher in the rear 39 than in the front 38. Thus, top wall 32 is angled from back to front to allow for better display of the golf clubs 20. The openings 34 formed in top wall 32 may be in the form of holes or preslitted areas. Such openings 34 are designed to receive and house a plurality of support members 40.

Figure 2:
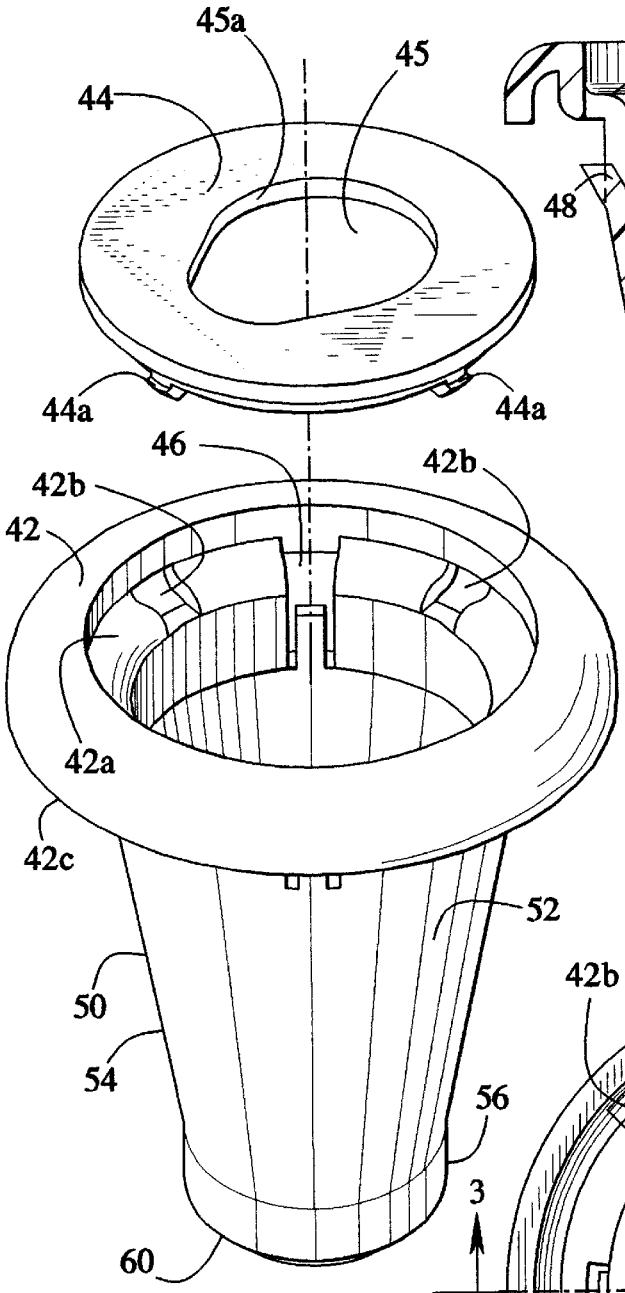
FIG. 2 is an enlarged, perspective view of the golf club support member.
Figure 3:
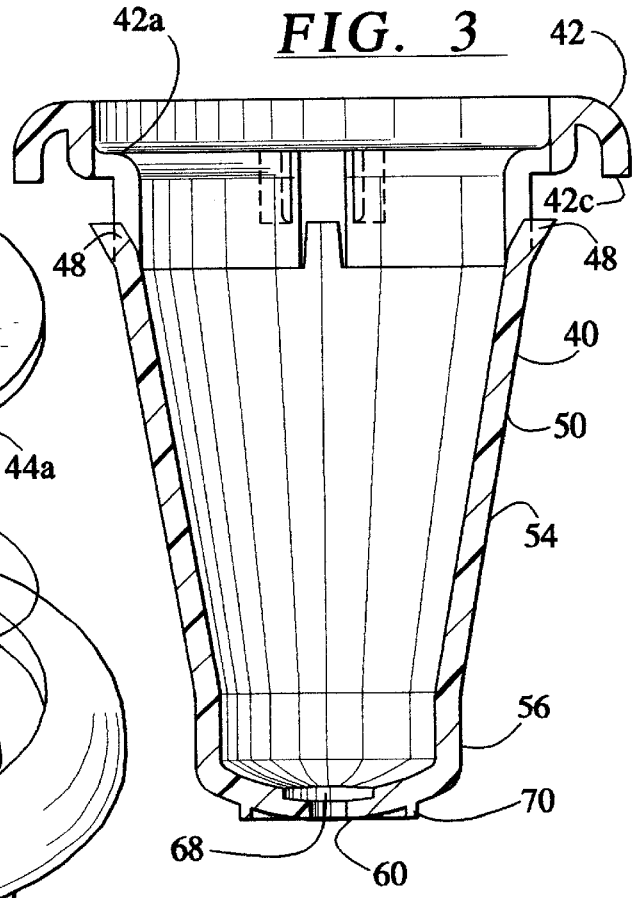
FIG. 3 is an enlarged, sectional view of the golf club support member shown in FIG. 4 along line 3—3.
Figure 4:
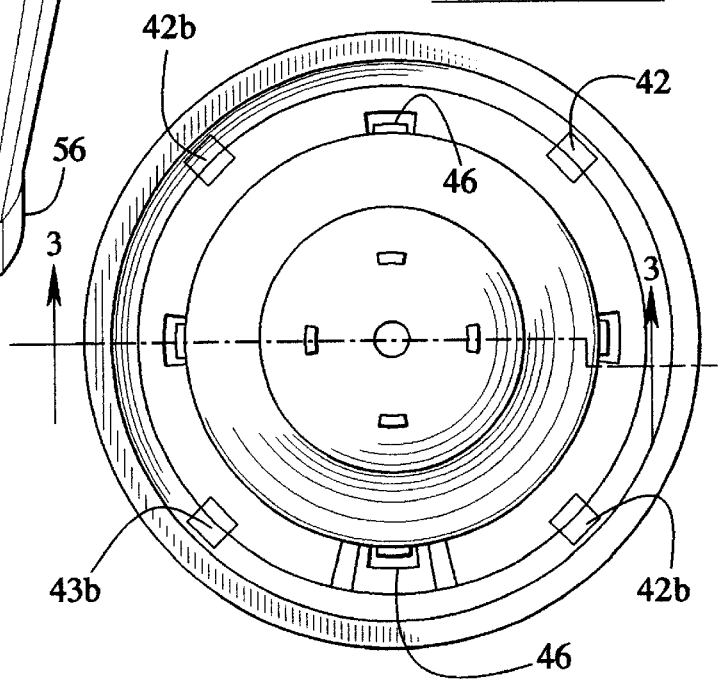
FIG. 4 is a top plan view of the golf club support member.
Figure 8:
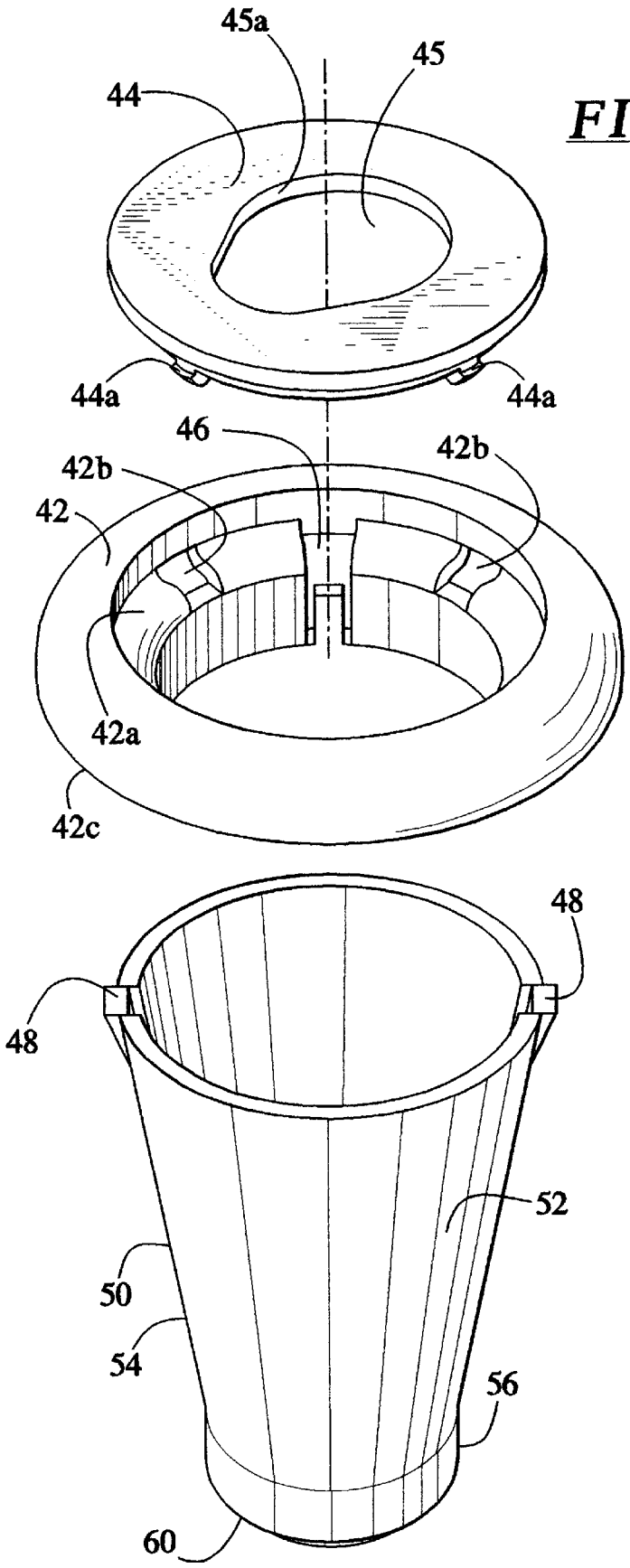
FIG. 8 is an exploded view of the support member shown in FIG. 2.

As shown in FIG. 3, the preferred embodiment of the present invention may include support members where each support member 40 may include a top section 42 removably attached to a bottom section 50. An alternative embodiment of the present invention may also combine the top section 42 and the bottom section 50 into a unitary object which could be injection molded or vacuum molded. As shown in FIG. 2, the top section 42 is further comprised of a removable support cap 44 and attachment means 46 for securing the top section 42 to the bottom section 50. As shown in FIGS. 2–4, the attachment means are comprised of a male fastener releasably inserted within and attached to a female fastener. It should be understood by those skilled in the art that other attachment means 46 may also be utilized, as long as the attachment means 46 releasably connect the top section 42 to the bottom section 50. The support cap 44 also includes a tear drop shaped aperture 45 and at least one male fastener 44*a* for engaging slot 42*b* in top section 42 and for releasably attaching the support cap 44 to the top section 42. In the present embodiment, the support cap 44 is designed to snap fit into the top section 42. The top section 42 further includes an inside shoulder 42*a* for supporting the support cap 44 and at least one slot 42*b* for releasably securing the support cap 44 to the top section 42. As shown in FIG. 5, the top section also includes an outside ridge 42*c*. The outside ridge 42*c* rests on the portion of the top wall 32 which surrounds the opening 34.

The bottom section 50 includes a support side wall 52 and a bottom wall 60. The support side wall 52 defines an inverted frustoconically shaped upper portion 54 and a cylindrically shaped lower portion 56. The top section 42 is attached to the upper portion 54 of the support side wall 52. The bottom wall 60 is attached to the lower portion 56 of the support side wall 52 and is capable of supporting a distal or butt end 62 of the grip portion 28 of the shaft 22.

As shown in FIGS. 1 and 2, the aperture 45 includes an inside edge 45*a* for supporting a second point 64 on the grip portion 28 of the shaft 22. The second point 64 is located between the butt end 62 of the grip portion 28 and the golf club head 25, but the second point is preferably located at the portion of the grip portion 28 which is furthest from the butt end 62. The aperture 45 may be a tear drop shape, as shown in FIG. 2, with the larger diameter portion readily receiving the grip portion 28 of the club 20. The narrow portion of the aperture 45 may be slightly smaller in diameter than the grip portion 28 diameter so that the club may be moved forward toward the front of the display where the edges 45*a* of the aperture 45 abut the grip portion 28 and hold the club 20 in place. In addition, the lower portion 56 may support a third point 66 on the grip portion 28 of the shaft 22. The third point 66 is located between the butt end 62 and the second point 64. The bottom wall 60 of the present invention includes a depressed portion 68 for allowing the support member 40 to receive a screw or other fastening device thereby securing the support member to a supporting structure. The bottom wall 60 also includes a ring 70 which extends downwardly from the bottom wall 60 and which is substantially flat and capable of resting on a flat surface.

In the present invention, the aperture 45 may include an inside edge 45*a* which is rounded to prevent scratching or abrading the grip portion 28. An alternative embodiment of the invention includes an inside edge 45*a* which may be covered with a material, such as rubber or foam, that will also prevent the inside edge 45*a* from scratching or abrading the grip portion 28. The display rack 10 is also designed to include a plurality of support members 40 which rest within the openings 34 and snap into place or include mounting means 48 for attaching the support member 40 to the display housing 30. One embodiment of the present invention includes mounting means 48 which are comprised of a flared out portion of the sidewall 52 where the flared out portion is flexible and extends over a distance that is greater than the width of the opening 34 thereby allowing the mounting means 48 to lock the support member 40 in place. Therefore, rows and columns of golf clubs may be supported and displayed within a single housing 30.

For displaying and supporting a golf club 20 with a shaft 22 having a first end 24 an a second end 26, a display rack 10 is provided. The shaft 22 further comprises a golf club head 25 attached to the first end 24 of the shaft 22 and a grip portion 28 that merges with the second end 26 of the shaft 22. The display rack 10 is comprised of a display housing 30 with a top wall 32 that includes at least one opening 34 and at least one support member 40, the support member 40 being mounted within the opening 34. In addition, the support member 40 includes a support cap 44 with an aperture 45 for receiving the golf club 20, a support side wall 52 with a top end and a bottom end, which defines a frustoconically shaped upper portion 54 and a cylindrically shaped lower portion 56, and a bottom wall 60. The support cap 44 is releasably connected to the top end of the support side wall 52 and the bottom wall 60 merges with the bottom end of the support side wall 52. As shown in FIG. 1, for displaying and supporting the golf club 20, the golf club 20 is inserted into the aperture 45 whereby the shaft 20 is received and supported by the lower portion 56 of the support member 40.

While the invention has been particularly shown and described with reference to a particular embodiment thereof, it will be understood by those skilled in the art that various changes in form and detail may be made therein without departing from the spirit and scope of the invention. The present embodiment, therefore, is to be considered in all respect as illustrative and not restrictive, and the invention is not to be limited to the details given herein.

I claim:

1. A display rack for a golf club having a shaft with a first end portion and a second portion wherein the first end portion is attached to a golf club head and the second end portion of the shaft includes a grip portion for allowing a user to hold the golf club, comprising:

a display housing having a top wall with a plurality of openings;

a support member mounted within one of the openings of the top wall of the display housing, the support member being comprised of a top section removably attached to a bottom section, said top section comprising a removable support cap and attachment means for securing the top section to the bottom section;

the support cap including an aperture and at least one male fastener for releasably attaching the support cap to the top section;

the top section including an inside shoulder for supporting the support cap and at least one female fastener for releasably securing the support cap to the top section and the top section including an outside ridge, where the ridge rests on a portion of the top wall which surrounds said one of the openings;

the bottom section including a support side wall with a upper portion and a lower portion, the upper portion being frustoconically shaped and the lower portion being cylindrically shaped, where the top section is attached to the upper portion of the support side wall;

a bottom wall attached to the lower portion of the support side wall, where the bottom wall is capable of supporting a distal end of the grip portion of the shaft;

the aperture including an inside edge which is capable of supporting a first point on the grip portion of the shaft which is located between the distal end of the grip portion of the shaft and the golf club head; and the lower portion being capable of supporting a second point on the grip portion of the shaft which is located between the distal end and the first point.

2. The display rack according to claim 1, wherein the top wall of the display housing is angled.

3. The display rack according to claim 2, wherein the support member includes means for mounting the support member to the display housing.

4. The display rack according to claim 1, wherein a diameter of the cylindrically shaped lower portion of the support side wall is larger than a diameter of the grip portion of the shaft.

5. The display rack according to claim 4, wherein the aperture is circular.

6. The display rack according to claim 4, wherein the aperture is tear drop shaped.

7. The display rack according to claim 4, wherein the aperture is oval.

8. The display rack according to claim 1, wherein the inside edge is rounded.

9. The display rack according to claim 1, wherein the inside edge is covered with a material to avoid scratching the shaft.

10. The display rack according to claim 9, wherein the material is comprised of rubber.

* * * * *